United States Patent [19]

Joedicke

[11] 4,378,408

[45] Mar. 29, 1983

[54] SILICATE COATED ROOFING GRANULES

[75] Inventor: Ingo B. Joedicke, Hedgesville, W. Va.

[73] Assignee: GAF Corporation, New York, N.Y.

[21] Appl. No.: 233,342

[22] Filed: Feb. 11, 1981

[51] Int. Cl.[3] ..... B32B 5/16; B32B 9/04

[52] U.S. Cl. ..... 428/403; 428/145; 428/150; 428/323; 428/332; 428/404; 428/446; 428/454

[58] Field of Search ..... 428/145, 150, 403, 404, 428/323, 332, 446, 454

[56] References Cited

U.S. PATENT DOCUMENTS

| | | | |
|---|---|---|---|
| 2,379,358 | 6/1945 | Jewett | 428/145 |
| 3,169,075 | 2/1965 | Morrow et al. | 428/145 |
| 3,255,031 | 6/1966 | Lodge et al. | 428/145 |
| 3,479,201 | 11/1969 | Sloan | 428/145 |

*Primary Examiner*—Thomas J. Herbert, Jr.

*Attorney, Agent, or Firm*—Joshua J. Ward; J. Gary Mohr; Marilyn J. Maue

[57] ABSTRACT

Roofing granules coated with insolubilized reaction product of a coating composition comprising water, kaolin clay, sodium silicate, pigment, and gas forming compound such as hydrogen peroxide or sodium perborate.

12 Claims, No Drawings

SILICATE COATED ROOFING GRANULES

BACKGROUND OF THE INVENTION

Roofing granules are extensively used in roll roofing and asphalt shingle compositions. Such granules are generally embedded in the asphalt coating on the surface of an asphalt impregnated base material such as roofing felt with the granules thus forming a coating that provides an adherent weather resistant exterior roofing surface. As the outer granule coating also provides the aesthetic effect observable with respect to the roof to which the roofing material is applied, the appearance of the granules is of major marketing importance. For this reason, a pigmented color coat is ordinarily applied to the base mineral granules to enhance their visual decorative effect.

Kaolin clay is used extensively in silicate paint formulations for coloring roofing granules. It serves as a filler, extender, moisture release agent and reactant to aid film insolubilization during high temperature firing. Although clay is a major component of such coating formulations, it alone lacks the brightness and opacity needed to hide the dark underlying base rock of the granule. Although kaolin clay consists mainly of alumino silicates, other constituents are present as a result of the clays natural origin. Iron and titanium impurities, for example, impart a buff or yellow color to the clay while organic impurities such as humic acid derivatives cause a grey coloration observed in sedimentary kaolin. Unbound iron in the form of extraneous Fe (III) minerals also causes discoloration. For these reasons, white colored roofing granule coatings using natural kaolin clay frequently require appreciable amounts of expensive $TiO_2$ to achieve desired color specifications.

White or light colored roofs are particularly favored in many areas. Titanium dioxide pigment is commonly used in the production of such white or light colored roofing granules. The $TiO_2$ is commonly used in conventional insolubilized alkali silicate coatings, such as those described in U.S. Pat. Nos. 2,379,358 to Jewett, 3,255,031 to Lodge et al, 3,479,201 to Sloan. As mentioned above, the kaolin clay which is frequently used in such coatings contains impurities such as iron, titanium and humic acid which tend to discolor the clay. Organic impurities, in particular, cause the clay to draken upon exposure to high temperature. This requires the use of larger amounts of $TiO_2$ then would otherwise be necessary or desirable.

The pigment requirements in silicate-clay coating formulations, particularly $TiO_2$ in white coatings, can be reduced by increasing the brightness of the clay. This can be achieved by oxidation and/or reduction bleaching to remove discoloring clay impurities. Pigment requirements can be further reduced by increasing the opacity, or hiding power, of the coating itself. This can be accomplished by using clays and pigments of higher purity and smaller particle size. The use of calcined or specially opacified clays can also be effective. Unfortunatley, the use of raw materials of a higher state of purity and/or subdivision generally increases the cost.

The intentional introduction of microvoids in a film to induce opacification is a well-known and inexpensive method of reducing pigment requirements. Voids can, for instance, be added in the form of hollow glass or plastic spheres. Use of such preformed voids eliminates the dependence on drying conditions, nature of the coating vehicle, and other factors governing in-situ void formation. Preformed voids are best suited for coatings that are designed for ambient cure. Voids can also be created in films by incorporating additives that induce cracks and microfractures during film curing. For example, polymer films containing UV light-curable components that shrink during curing are known. As the curable and non-curable components separate, opacifying microfractures appear at the phase boundaries. Light-scattering microvoids can also be formed by the evaporation of a droplet of volatile liquid, which is either emulsified into the coating or formed by precipitation during film formation. Loss of the volatile liquid takes place by diffusion through the coating matrix as the volatile liquid is simultaneously replaced by air.

Voids in a transparent film act as opacifiers by scattering part of the incident light that traverses the air/-film interfaces. Sodium silicate films, for example, are highly transparent when dried at ambient temperature, but become increasingly white and opaque as more complete water loss creates voids at higher temperatures. Unfortunately, the voids formed by drying neat silicate films are large and scatter light inefficiently. In addition, the film is weak because the voids are interconnected and the film surface is extensively disrupted. Similarly, premature gelling of incompletely dried silicate films also induces opacification by changing the film structure from a glass to an amorphous coating of individual light-scattering silica particles. This change is analogous to that of the differences between ice and snow. Amorphous coatings, however, are powdery and weak because there is little binding between the particles or to the substrate.

SUMMARY OF THE INVENTION

It is an object of the invention to provide novel aqueous coating compositions useful for coating roofing granules as well as roofing granules produced using such coatings.

Aqueous coating compositions of the invention which are useful for coating roofing granules comprise:

(a) water;

(b) kaolin clay;

(c) sodium silicate; and (d) a soluble, inorganic, gas forming compound.

Roofing granules of the invention comprise base mineral granules having coatings comprising insolubilized reaction product of the coating compositions of the invention.

Hydrogen peroxide, ($H_2O_2$) and sodium perborate ($NaBO_3$) are the preferred gas forming compounds for use in the invention. The inclusion of pigment such as titanium dioxide ($TiO_2$) is also preferred at least where the coating composition is intended to be used as the only coating or as the outer coating on roofing granules.

DETAILED DESCRIPTION OF THE INVENTION

The invention involves the addition of film opacifiers in the form of inexpensive gas-forming compounds to the silicate paint prior to granule coating. Such compounds must be capable of undergoing chemical and/or thermal decomposition to gaseous products early in the film drying process. This results in the uniform dispersion of microscopic gas bubbles throughout the film. Upon completion of the film firing process, the bubbles remain as light-scattering microvoids that greatly enhance film opacity and afford significant pigment reductions, particularly $TiO_2$ in whites. By proper adjustment of silicate-clay proportions, roofing granule coatings of acceptable quality can be produced.

Base mineral granules for use in the invention may be any of the conventional type granules normally used in the manufacture of roofing materials. Such granules may, for instance, be of material such as greenstone, nephylene syenite, common gravel slate, gannister, quartzite, greystone, etc. Granules are frequently used in a size range between about 10 and about 35 mesh, i.e. particle sizes which will pass through a 10 mesh screen but be retained on a 35 mesh screen. The use of larger and smaller granules is, however, within the scope of the invention.

Kaolin clay for use in the invention may be any of the conventional hydrated kaolin clays used in granule coatings of the type discussed herein and is usually present in amounts between about 45 and about 65 wt% based on total coating on a dry basis. Conventional silicates are likewise suitable and are usually present in amounts between about 30 and about 40 wt% on the same basis. Other conventional ingredients such as ultramarine blue tint may also of course be used.

Water is used as desired to provide the desired viscosity of coating with aqueous coating compositions of the invention generally comprising between about 40 and about 60 wt% solids based on total aqueous composition.

Coating compositions of the invention preferably also contain pigment with titanium dioxide being an especially preferred pigment for white coatings. Where used, pigment is preferably present in the coating composition in amounts between about 0.5 and about 10 wt% based on total dry weight of coating composition.

Gas forming compounds are used in coating compositions of the invention in amounts generally between about 0.25 and about 2.5 wt% based on total dry weight of the composition with amounts between about 0.5 and about 1.5 wt% being especially preferred.

Hydrogen peroxide and alkali metal perborates, especially sodium perborate, are preferred gas forming compounds for use in coating compositions of the invention, although other suitable gas forming compounds, such as alkali metal persulfates, borohydrides, and azides may also be used. The peroxide, perborate and persulfate compounds decompose at low temperature in the alkaline silicate medium to form $O_2$ gas. In contrast, the borohydrides decompose to gaseous $H_2$. The azides generally require higher temperatures to form $N_2$ gas and form voids in silicate films via dispersed crystal decomposition rather than by gas bubble formation. Other soluble compounds that thermally decompose to gaseous products below about 500° F. when dispersed in an alkaline silicate film would also be expected to be effective opacifiers of this invention. Hydrogen peroxide and sodium perborate are generally preferred because they are relatively cheap and easy to use as compared with other gas forming compounds. When sodium perborate is used, it is generally preferable to include boric acid in amounts between about 50 and about 150 wt%, more preferably between about 80 and about 120%, based on sodium perborate in order to improve the solubility of the sodium perborate.

Hydrogen peroxide is an especially preferred gas forming compound for use in the invention despite its corrosive nature. The hydrogen peroxide decomposes slowly in aqueous solution, but the alkaline sodium silicate medium of the compositions of the invention greatly enhances the decomposition of the hydrogen peroxide to form microscopic oxygen gas bubbles. Increased temperature also accelerates this decomposition. Increasing coating viscosity during drying and firing serves to suspend the microscopic oxygen bubbles within the film and hinders their coalescense into larger bubbles. Sodium perborate functions by decomposition in solution into hydrogen peroxide and $NaBO_2$ with the formation of oxygen gas bubbles then proceeding due to decomposition of the hydrogen peroxide. Sodium perborate has the advantage of being safer to handle than hydrogen peroxide and is more stable in silicate paint mixtures. However, the perborate requires more attention to insure complete dissolution in the aqueous phase of the paint.

Inclusion of gas forming compounds in silicate coatings for roofing granules in accordance with the invention results in extraordinary lightening of the fired coating. As mentioned, this is due to decomposition of the dissolved gas forming compounds to form microscopic gas bubbles. As the coating dries and is fired, the dispersed bubbles become light scattering microvoids that greatly enhance the whiteness and opacity of the silicate coating. Microscopic examination of a cross-section of fired silicate-clay coating of the invention shows a very uniform distribution of small closed voids distributed in an opaque solid matrix. The matrix has a layered, plate-like structure aligned parallel with the base mineral granule substrate. The voids are also parallel with the substrate and also have a plate-like shape. In a preferred embodiment at least a majority of the voids are between about 0.05 and about 0.5 micron thick. In contrast, a conventional fired silicate-clay coating with no gas forming compound used shows very large interconnecting voids which are distributed in a translucent glassy matrix. Both coatings, however, fire to the same thickness. This means that the opacified coating of the invention is not expanded or foamed any more than regular silicate-clay coatings and is distinguished from conventional coatings by a structure in which a strong matrix encapsulates voids of micron size.

Just as the surface area of a given volume of material increases with decreasing particle size, the available surface area of an opacified silicate film is significantly greater than that of a conventional film. This is because the voids are smaller and much more numerous. As a result opacified silicate films tend to show higher extractable alkalinities and reduced abrasion resistance after firing. Both of these quality defects can be corrected by increasing the amount of Kaolin clay in the opacified coating composition. An increase in clay content of 30–50% is sufficient to bring opacified film quality to a level comparable to that of conventional silicate-clay coatings while maintaining the benefit of greatly reduced pigment demand.

In general, coating compositions of the invention are, except for the addition of a gas forming compound as described herein, prepared and used in a conventional manner to coat roofing granules. As in the preparation of conventional roofing granules, the roofing granules of the present invention are prepared using any suitable base raw mineral granules, such as greenstone or nephylene syenite. In the conventional production of artifically colored roofing granules, an alkali metal silicate-clay coating is applied to the base mineral granules and fired to produce a moisture permeable, substantially water insoluble, durable, pigmented coating on the base mineral granules. In one method, referred to as the continuous paint slurry process, crushed and screen graded mineral granules are constantly mixed with a paint slurry containing pigment, clay and sodium silicate in suitable mixing equipment. The thus color coated granules are then heated to a temperature that may range from about 600° to about 1200° F. in a rotary-type kiln. In contrast to conventional coatings, the opacity of the fired coating of the present invention is remarkably independent of firing temperature. Dehydration of the silicate occurs, and an extremely hard, color-coated granule is obtained. In the event that the granules are fired at lower temperatures, e.g. about 500° F., the silicate-clay coating may require treatment by the addition of a pickling agent, such as $AlCl_3$ solution, in order to properly insolubilize the coating. Upon cooling, the color coated granules are generally post treated with suitable processing oils and/or coating compositions as is known in the art.

The gas forming compound called for by the invention is preferably added to the coating composition along with the other ingredients in a manner that will optimize mixing and stability. Hydrogen peroxide, for example, is completely miscible in the aqueous paint mixture and can be added at any time during the mixing process. To minimize opacifier decomposition, however, it would be preferable to add the peroxide as the final ingredient just prior to paint use. Sodium perborate, on the other hand, must be dissolved completely in water prior to adding the sodium silicate components. Since some slow decomposition of the gas forming compound prior to its activation by firing the coating is to be expected, it is preferred that the gas forming compound, when used in the preferred amount be added to the coating composition not more than about 4 hours and more preferably not more than about 2 hours prior to firing of the coating. Granules may be coated in one or more coats with any desired amount of coating material and gas forming compound may be used in any one or more of the coatings. Gas forming compound is preferably used in the outer coating. Use of between about 90 and about 120 pounds of coating per ton of granules on a dry basis is preferred. In a particularly preferred embodiment of the invention and in accordance with conventional practice, two separate coatings are preferably used to produce white-colored granules with the innermost coating comprising between about 50 and about 70 pounds per ton of granules on a dry basis and containing little or no titanium dioxide and no gas forming compound. The outer coating is preferably used in amounts between 40 and about 50 pounds per ton of granules on a dry basis and contains $TiO_2$ and gas forming compound. Also in accordance with normal practice, granules coated with coating compositions of the invention are perferably fired at temperatures between about 900° and 1100° F. to insolubilize the silicate coatings. Coating compositions of the invention may be applied in conventional thicknesses. In a preferred embodiment where two coatings are applied each is preferably between about 0.01 mm and about 0.02 mm thick.

The following examples are intended to illustrate the invention without limiting the scope thereof.

EXAMPLE 1

In the laboratory, the effectiveness of various compounds as silicate film opacifiers was examined by measuring the transparency of paint films on a glass plate support. Paint mixtures containing by weight 30 parts water, 56 parts sodium silicate ($SiO_2/Na_2O=2.5$, 41% solids,) 25 parts hydrated Kaolin, and 1 part of one of the dissolved components listed in Table I were deposited as 5 mil drawdown films and oven fired. The reduction in film transparency (increase in opacity) was determined by measuring the Hunter Lightness (L) of the drawdown films above a white background ($L_w$) and a black background ($L_b$). The films with the highest opacity would show the smallest values of $\Delta L=L_w-L_b$. The transparency values $\Delta L$ at various film drying temperatures are presented in Table I.

TABLE I

Film Transparency Reduction by Various Opacifiers
5 Mil Drawdown Films Containing
0.89% Initial Opacifier Content

| Compound | Transparency ΔL (250° F.) | Transparency ΔL (500° F.) | Transparency ΔL (1000° F.) | Whiteness $L_B$ (1000° F.) |
|---|---|---|---|---|
| 30% $H_2O_2$* | 5.5 | 3.8 | 2.9 | 85.6 |
| $NaBO_3/H_3BO_3$ | 8.0 | 2.7 | 2.1 | 86.8 |
| $NaN_3$ | 36.5 | 10.3 | 2.6 | 82.4 |
| $NaBH_4$ | 4.1 | 3.1 | 1.9 | 84.1 |
| $NaClO_3$ | 47.8 | 32.1 | 11.3 | 74.0 |
| Oxone | 24.7 | 15.7 | 10.2 | 69.1 |
| $NaNO_3$ | 43.8 | 25.2 | 9.9 | 75.2 |
| ** | 40.3 | 35.6 | 10.1 | 67.2 |

*i.e. 0.267% $H_2O_2$
**No opacifier present, silicate-clay film only $H_2O_2$, $NaBO_3$, and $NaBH_4$ are seen to be the most effective opacifiers at low temperature because of their ease of decomposition to gaseous products. Oxone, a potassium persulfate compound, also releases $O_2$ gas at low temperature but has a much lower available $O_2$ content than $H_2O_2$ or $NaBO_3$. Thus, higher amounts of oxone would have to be present in the film to be effective.

$NaN_3$ is seen to be an effective opacifier at elevated temperature. Here, void formation proceeds by thermal decomposition of crystals dispersed in the film rather than by gas bubble formation. $NaClO_3$ and $NaNO_3$ show no significant opacifying properties because of the high temperatures needed for decomposition. They do induce a lighter film by oxidizing clay impurities thus acting as clay bleaching agents. In fact, Table I shows that the whitest films at 1000° F. are produced by the compounds with both opacifying and oxidizing properties, i.e., $H_2O_2$ and $NaBO_3$.

EXAMPLE 2

In order to test the effectiveness of sodium perborate and hydrogen peroxide as silicate film opacifiers in the production of roofing granules of the invention, three different samples of roofing granules were prepared in the laboratory. To insure that these samples would be identical except for the composition of the second coating, first-coat granules prepared in a commercial granules plant were used. One of the three second coat formulations described in Table II was then applied to each sample of granules in the laboratory. The painted granules were passed through a rotary pilot kiln heated to 950°-1000° F. to completely insolubilize the coating. Samples of the cooled "kiln" granules were tested for "Hunter color L", a conventional test in which the L-value measures lightness with an L-value of 100 being perfectly white.

The second coat trial formula No. 1 shown in Table II contained sodium perborate opacifier and boric acid to enhance opacifier solubility. These components were dissolved in the water prior to adding the other ingredients of the coating composition. An additional 40% Kaolin clay loading was used to maintain proper coating quality. As shown in Table II, trial formula No. 1 employed 80% less $TiO_2$ than the control sample and still achieved a higher level of lightness.

The second coat trial formula No. 2 contained hydrogen peroxide opacifier. Due to the instability of $H_2O_2$ in an alkaline medium, the peroxide was added to the paint mixture after all other components had been thoroughly mixed and just prior to use of the paint in the coating process. An additional 40% Kaolin clay was again used as well as a small quantity of blue tint to reduce yellowness. As shown in Table II, trial formula No. 2 employed 60% less $TiO_2$ than the control sample and still achieved a comparable level of lightness. Both trial formula No. 1 and No. 2 allowed a significant raw material cost reduction while maintaining acceptable color and quality.

TABLE II

| | 2nd Coat Compositions | | |
|---|---|---|---|
| | Weight (lbs.) Per Ton of Granules Coated | | |
| Ingredient | Control | Trial No. 1 | Trial No. 2 |
| Water | 28 | 28 | 28 |
| Sodium Perborate | — | 1 | — |
| Boric Acid | — | 1 | — |
| Sodium Silicate* | 56 | 56 | 56 |
| Kaolin Clay | 25 | 35 | 35 |
| Titanium Dioxide | 5 | 1 | 2 |
| Blue Tint | — | — | .05 |
| 30% Hydrogen Peroxide | — | — | 2 |
| Hunter L-value | 62.7 | 63.0 | 62.6 |

*Weight Ratio $SiO_2/Na_2O$ = 2.5, 41% solids.

While the invention has been described above with respect to certain preferred embodiments thereof, it will be understood that various changes and modifications can be made without departing from the spirit and scope of the invention.

What is claimed is:

1. A roofing granule comprising a base mineral granule substrate having a dehydrated, pigmented, moisture permeable, substantially water insoluble sodium silicate kaolin clay coating, said coating comprising an opaque, solid matrix having a layered plate-like structure aligned parallel with the substrate and containing light scattering closed voids uniformly and individually dispersed therein to thereby enhance the opacity of the coating, said voids also having a plate-like shape and being aligned parallel with the substrate with at least a majority of the voids being between about 0.05 and about 0.5 micron thick.

2. A roofing granule comprising a base mineral granule having a coating comprising insolubilized reaction product of a mixture of:

(a) water;

(b) kaolin clay;

(c) sodium silicate; and (d) inorganic gas forming compound which is soluble in said mixture and decomposes to gaseous products below about 500° F. when dispersed in an alkaline silicate film.

3. A roofing granule according to claim 2 wherein the gas forming compound is hydrogen peroxide or an alkali metal perborate.

4. A roofing granule according to claim 2 wherein the gas forming compound comprises sodium perborate and wherein boric acid is also present in an amount between about 50 and about 150 wt% based on sodium perborate.

5. A roofing granule according to claim 2 wherein clay is present in an amount between about 45 and about 65 wt% based on total coating on a dry basis.

6. A roofing granule according to claim 2 wherein sodium silicate is present in the coating composition in an amount between about 30 and about 40 wt% based on total coating composition on a dry basis and water is present in the coating composition in an amount between about 40 and about 60 wt% based on total coating composition.

7. A roofing granule according to claim 2 wherein the gas forming compound is selected from the group consisting of hydrogen peroxide, alkali metal perborates, alkali metal persulfates, alkali metal borohydrides, and alkali metal azides.

8. A roofing granule according to claim 2 wherein:

(a) the gas forming compound is hydrogen peroxide or sodium perborate and is present in the coating composition in an amount between about 0.25 and about 2.5 wt% based on dry weight of the coating composition;

(b) clay is present in an amount between about 45 and about 65 wt% based on coating composition on a dry basis;

(c) sodium silicate is present in an amount between about 30 and about 40 wt% based on total coating on a dry basis;

(d) water is present in an amount between about 40 and about 60 wt% based on coating composition; and (e) titanium dioxide is present in an amount between about 1 and about 5 wt% based on total coating on a dry basis.

9. A roofing granule according to claim 2 wherein gas forming compound is present in the coating composition in an amount between about 0.25 and about 2.5 wt% based on dry weight of the total coating composition.

10. A roofing granule according to claim 9 wherein the gas forming compound is hydrogen peroxide or sodium perborate.

11. A roofing granule according to claim 2 wherein pigment is also present in the coating composition in an amount between about 0.5 and about 10 wt% based on total coating composition on a dry basis.

12. A roofing granule according to claim 11 wherein the pigment is titanium dioxide and is present in the coating composition in an amount between about 1 and about 5 wt% based on total coating composition on a dry basis.

* * * * *